United States Patent [19]

Cherry

[11] Patent Number: 4,501,941

[45] Date of Patent: Feb. 26, 1985

[54] VACUUM INTERRUPTER CONTACT MATERIAL

[75] Inventor: Sidney J. Cherry, Elmira, N.Y.

[73] Assignee: Westinghouse Electric Corp., Pittsburgh, Pa.

[21] Appl. No.: 436,867

[22] Filed: Oct. 26, 1982

[51] Int. Cl.[3] ..... H01H 33/66

[52] U.S. Cl. ..... 200/144 B; 200/265; 200/266

[58] Field of Search ..... 200/144 B, 265, 266

[56] References Cited

U.S. PATENT DOCUMENTS 3,818,163 6/1974 Robinson ..... 200/144 B 4,190,723 2/1980 Gainer ..... 200/144 B

OTHER PUBLICATIONS

"Modern Developments in Powder Metallurgy", by Henry H. Hausner, vol. 5, Plenum Press, New York--London, 1971.

*Primary Examiner*—Robert S. Macon

*Attorney, Agent, or Firm*—W. G. Sutcliff

[57] ABSTRACT

A vacuum interrupter electrical contact which exhibits an improved voltage withstand characteristic. The electrical contact comprises a minor portion of selected refractory metal and a major portion of dispersion strengthened copper.

6 Claims, 1 Drawing Figure

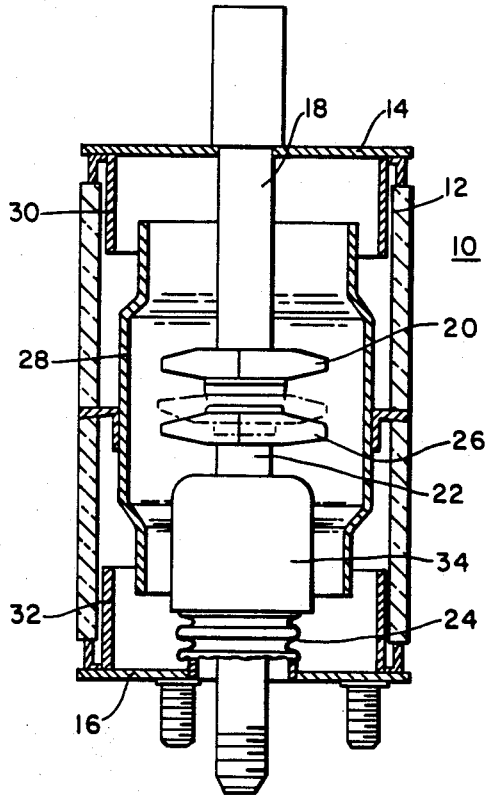
18
14
12
30
10
20
28
26
22
34
32
24
16

VACUUM INTERRUPTER CONTACT MATERIAL

BACKGROUND OF THE INVENTION

The present invention relates to vacuum interrupter electrical apparatus and more importantly to the electrical contacts of such apparatus. Vacuum interrupters find application as circuit protection devices in electrical transmission and distribution systems. The device basically comprises movable contacts disposed within an evacuated sealed envelope, with the contacts being closed in a current carrying configuration and separated or opened to interrupt the operational current.

The selection of materials for the electrical contacts of a vacuum interrupter significantly determine the operational characteristics of the vacuum interrupter. The contacts are typically made of composite materials frequently made by mixing a powder of a high conductivity material with a powder of a high melting point material, pressing them together, and sintering the compact to form a strong contact. The combination of such powder materials results in the contact having good conductivity characteristic for normal carrying operation, and low erosion characteristic when the contacts are separated in the vacuum and an interrupting arc is extinguished to interrupt the operating current. It is well known that the breakdown voltage characteristic of such contacts when separated in vacuum is related to the composition materials of the contact. By breakdown voltage is meant the voltage at which a restrike of an arc is formed between the separated contacts due to the voltage which appears across the separated contacts. It is well known that high conductivity contact materials such as copper and silver have a much lower breakdown voltage characteristic than the higher melting point materials such a chromium and tungsten. A widely used contact material is a blend of a high conductivity material such as copper and a high melting point refractory metal such as chromium or tungsten. A widely used chromium matrix contact material which is infiltrated with copper is described in U.S. Pat. No. 3,818,163. It is well known that contacts made from copper and chromium mixtures display breakdown voltage characteristic which is somewhere between that for the copper or chromium alone.

In more recent copper chromium vacuum contacts a higher percentage of copper, in the range of 65 to 90 wt.% of the contact, has been fabricated as disclosed in U.S. Pat. No. 4,190,753. This high copper content is desirable from an operating current carrying efficiency point of view, and to provide improved capability for interrupting fault current, but has been found to lower the voltage breakdown characteristic of the contact.

It is therefore desirable to be able to fabricate a high copper content vacuum interrupter contact material which exhibits improved voltage breakdown characteristic while retaining the high conductivity characteristic of such contacts.

The dispersion strengthening of metals including copper is known in the art as described in "Modern Developments in Powder Metallurgy", edited by H. H. Hausner, Vol. 5 Materials and Properties, Plenum Press, 1971, which includes a chapter titled Dispersion Strengthening.

SUMMARY OF THE INVENTION

A vacuum interrupter electrical contact comprises a minor portion of selected refractory metal and a major portion of dispersion strengthened copper. This contact exhibits an improved voltage withstand capability. The selected refractory metal is preferably chromium. The preferred dispersing agent is aluminum oxide, with the weight ratio of copper to aluminum oxide in the dispersion strengthened copper being greater than about 98.9 to 1.1.

BRIEF DESCRIPTION OF THE DRAWING

The sole FIGURE is an elevational view in section of a vacuum interrupter assembly using contacts of the present invention.

DESCRIPTION OF THE PREFERRED EMBODIMENT

The vacuum interrupter device 10 is shown in FIG. 1, comprises a generally cylindrical insulating body portion 12, having sealed end members 14, 16 at opposed ends of the body 12. The sealed evacuated device 10 is evacuated to a pressure of better than $10^{-4}$ Torr. A contact assembly 18 is brought through end plate 14 and has an improved electrical contact 20 disposed at the terminal end of the conductive post of the contact assembly. The other contact assembly 22 is movably mounted through end plate 16 and includes a bellows member 24 which permits movement of the electrical contact 26 disposed at the end of the assembly into closed circuit contact with contact 20. A plurality of vapor shields 28, 30, and 32 are provided within the sealed envelope about the contacts and the arcing area. A shield member 34 is provided about the bellows 24. Shield 28 is an electrically floating central shield, and shields 30 and 32 overlap the ends of the central shield to prevent deposition of arcing material upon the insulating envelope.

The electrical contacts 20 and 26 are typically disc-like members, but can have a variety of shapes including spirally directed arms for producing a circular arc driving force to keep the arc which forms on separation of the contacts in motion about the contact to minimize localized heating. The electrical contacts 20 and 26 are formed by the fabrication method set forth in greater detail in U.S. Pat. No. 4,190,753, issued Feb. 26, 1980, and owned by the assignee of the present invention. The basic fabrication method set forth in the aforementioned patent incorporated by reference herein utilizes a process which includes steps of admixing the copper and chromium powders, cold isostatically pressing the admixed powders at high pressure to form a contact of high intermediate density, and thereafter vacuum sintering the compact at a temperature below the melting point of copper to achieve a high density contact. The improvement effected by the present invention is to utilize copper powder which is dipersed with finely divided aluminum oxide to be admixed with the chromium powder in the initial fabrication step. The copper powder dispersed with submicroscopic aluminum oxide is by way of example "Glid Cop AL-60", a trademarked material of the SCM Glidden Metals Company. The copper powder which is dispersed with the submicroscopic aluminum oxide typically has a powder size of 400 mesh while the chromium powder has a mesh size of 200. The weight ratio of dispersed copper and aluminum oxide to chromium is typically preferred at about 3 to 1, while the weight ratio of copper to aluminum oxide is greater than about 98.9 to 1.1. The admixed dispersed copper powder and chromium powder are pressed to the required shape in a die at about 60 tons per square inch. The pressed to shape compact is then sintered at a temperature below the melting point of copper, for example to about 1050° C. in vacuum for about 4 hours.

It has been found that electrical contacts of the present invention utilizing the copper dispersed with aluminum oxide produce a high strength contact with the desired high conductivity characteristic and yet with an improved voltage breakdown characteristic.

The refractory metal minor portion of the contact is preferably chromium, but other refractory metals such as tungsten or tungsten carbide can be utilized.

The aluminum oxide dispersing agent can be substituted for by other well known dispersing agents such as titanium dioxide.

I claim:

1. An improved vacuum interrupter electrical contact which exhibits an improved high voltage withstand characteristic and comprises a minor proportion of selected refractory metal, and a major proportion of dispersion strengthened copper.

2. The electrical contact set forth in claim 1, wherein the selected refractory metal is chromium.

3. The electrical contact set forth in claim 2, wherein the weight ratio of dispersion strengthened copper to chromium is about 3 to 1.

4. The electrical contact set forth in claim 1, wherein the dispersion strengthened copper includes aluminum oxide as the dispersing medium.

5. The electrical contact set forth in claim 4, wherein the weight ratio of copper to aluminum oxide in the dispersion strengthened copper is greater than about 98.9 to 1.1.

6. An improved vacuum interrupter electrical contact which exhibits an improved high voltage withstand characteristic, which contact comprises dispersion strengthened copper and chromium, with the weight ratio of dispersion strengthened copper to chromium being about 3 to 1, and wherein aluminum oxide is the dispersing agent with the copper, and wherein the weight ratio of copper to aluminum oxide is greater than about 98.9 to 1.1.

* * * * *